US009287671B1

(12) United States Patent
Chen

(10) Patent No.: US 9,287,671 B1
(45) Date of Patent: Mar. 15, 2016

(54) PLUG CONNECTOR, RECEPTACLE CONNECTOR AND ELECTRICAL CONNECTOR ASSEMBLY

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 14/680,450

(22) Filed: Apr. 7, 2015

(30) Foreign Application Priority Data

Oct. 13, 2014 (CN) ..... 2014 1 0535644
Oct. 13, 2014 (CN) ..... 2014 2 0588179

(51) Int. Cl.
*H01R 12/00* (2006.01)
*H01R 25/00* (2006.01)
*H01R 24/60* (2011.01)
*H01R 107/00* (2006.01)

(52) U.S. Cl.
CPC ..... *H01R 25/00* (2013.01); *H01R 24/60* (2013.01); *H01R 2107/00* (2013.01)

(58) Field of Classification Search
None
See application file for complete search history.

(56) References Cited

U.S. PATENT DOCUMENTS 6,319,075 B1 11/2001 Clark et al.
7,001,189 B1 * 2/2006 McGowan ..... H01R 43/0256 439/79
7,841,894 B2 * 11/2010 Gong ..... H01R 12/712 439/540.1
7,878,847 B2 * 2/2011 He ..... H01R 27/00 439/541.5
8,702,445 B2 * 4/2014 Yu ..... H01R 13/46 439/485
8,968,009 B2 * 3/2015 Chen ..... H01R 12/7088 439/79
9,153,887 B2 * 10/2015 Chen ..... H01R 12/7088

* cited by examiner

*Primary Examiner* — Xuong Chung Trans
(74) *Attorney, Agent, or Firm* — Osha Liang LLP

(57) ABSTRACT

A plug connector, a receptacle connector and an electrical connector assembly are disclosed. When the plug connector is engaged with the receptacle connector, multiple power mating bodies and one signal mating body of the receptacle connector respectively enter into corresponding plug power ports and a plug signal port of the plug connector, plug power contacts and plug signal contacts respectively enter into receptacle power ports and receptacle signal ports, a vertical blade-shaped mating end of each plug power contact is inserted into an elastic clamp of the corresponding receptacle power contact, and a head of each plug signal contact is inserted into a forked head of the corresponding receptacle signal contact.

9 Claims, 10 Drawing Sheets

PLUG CONNECTOR, RECEPTACLE CONNECTOR AND ELECTRICAL CONNECTOR ASSEMBLY

BACKGROUND OF THE INVENTION

1. Field of the Invention

The present invention relates to a connector technology, and more particularly to a horizontal plug connector, a vertical receptacle connector and an assembly of the plug connector and the receptacle connector.

2. Description of the Prior Art

At present, the power function and the signal function are constructed in an electrical connector, but this electrical connector is usually low and hybrid. This electrical connector occupies the small height space, but occupies too much edge space of a circuit board along a length direction thereof. Because the edge space of the circuit board is limited, other electrical connectors can not be further mounted on the edge of the circuit board. For example, U.S. Pat. No. 6,319,075 discloses an electrical connector, in which a power module and a signal module are arranged side by side. Further, the power module has a large width size. So, the low type hybrid electric connector can only be suitable for an electrical device, which need a small height, and unsuitable for an electrical equipment, which need add other components onto the edge of the circuit board.

Hence, it is needed to provide a new connector, which can provide the power transmission function and the signal transmission function, has an optimized structure, and integrates the power module and the signal module together by a new mode, for satisfying the different requirements of the electrical equipments.

BRIEF SUMMARY OF THE INVENTION

One object of the present invention is to provide a plug connector, in which plug power contacts and plug signal contacts are compactly arranged for saving the edge space of a circuit board.

Another object of the present invention is to provide a receptacle connector, in which receptacle power contacts and receptacle signal contacts are compactly arranged for saving the edge space of a circuit board.

Further object of the present invention is to provide an electrical connector assembly including a plug connector and a receptacle connector, which can be stably connected for ensuring the power and signal transmission performance of the both.

To achieve the aforementioned objects or other objects of the present invention, the present invention adopts the following technical solution.

The present invention provides a plug connector, which comprises a plug housing, a retaining seat, a row of plug power contacts and a row of plug signal contacts. The plug housing has a mating portion located on the front of the plug housing and a mounting portion located on the rear thereof. A front surface of the mating portion is perpendicular to a bottom surface of the mounting portion. The front surface of the mating portion forms a row of vertical and parallel plug power ports having identical structures and one plug signal port located under the row of the plug power ports to form a stacked structure. A bottom of the plug signal port is open. The plug signal port has a top wall and two opposite sidewalls. The mounting portion forms a row of plug power contact-receiving passages passing through a rear surface and the bottom surface of the mounting portion to receive the plug power contacts. Each of the plug power contact-receiving passages is communicated with the corresponding plug power port. The mounting portion further forms a row of plug signal contact-receiving passages that are located on the bottom surface thereof and communicated with the plug signal port to receive the corresponding plug signal contacts. The retaining seat is drawer-shaped and has a bottom board, two opposite side boards and a rear board. The retaining seat is mounted on the mating portion of the plug housing to close the open bottom of the plug signal port and fixing the plug signal contacts. Each of the plug power contacts is a vertical plate and includes a mating end that is vertical blade-shaped and horizontally extending forward, a tail end being perpendicular to the mating end and extending downward, and a connecting part that is an L type vertical blade and connects the mating end and the tail end. The mating end passes through the corresponding plug power contact-receiving passage to enter into the corresponding plug power port, the connecting part is fixed in the corresponding plug power contact-receiving passage, and the tail end extends out of the bottom surface of the mounting portion. Each of the plug signal contacts includes a head horizontally extending forward, a tail being perpendicular to the head and vertically extending downward, and an L type retaining part connecting the head and the tail. The head is inserted into the plug signal port. One portion of the L type retaining part is fixed in the plug signal contact-receiving passage, and the other portion thereof is fixed in the retaining seat. The tail extends out of the bottom surface of the mounting portion.

In one embodiment, each of the two opposite sidewalls of the plug signal port forms a groove and a protrusion.

In one embodiment, an outside surface of each side board of the retaining seat has a rib corresponding to the groove, and the each side board has a notch corresponding to the protrusion.

In one embodiment, the rear board of the retaining seat forms a row of through holes, which pass through a front and rear surfaces of the rear board.

In one embodiment, the retaining part of the plug signal contact has a horizontal width part in a horizontal direction and a vertical width part in a vertical direction, the head of the plug signal contact passes through the through hole of the retaining seat and is inserted into the plug signal port, the horizontal width part is fixed in the through hole, and the vertical width part is fixed in the plug signal contact-receiving passage.

The present invention also provides a receptacle connector, which comprises a receptacle housing, a row of receptacle power contacts and a row of receptacle signal contacts. The receptacle housing includes a power receptacle housing and a signal receptacle housing mounted under the power receptacle housing. The power receptacle housing and the signal receptacle housing are stacked and connected together. The power receptacle housing includes a power base and a row of vertical power mating bodies having identical structures. The power mating bodies are in parallel and protrude forward from a front surface of the power base. The power base forms a row of receptacle power contact-receiving passages that pass through the front surface and a rear surface of the power base to receive the receptacle power contacts. A front surface of each power mating body forms one vertical receptacle power port that extends backward to the power base and is communicated with the corresponding receptacle power contact-receiving passage. The signal receptacle housing includes a flat signal base and a flat and horizontal signal mating body. The signal mating body horizontally protrudes forward from a front surface of the signal base. The signal base forms a row of receptacle signal contact-receiving passages that pass through the front surface and a rear surface of the signal base and are used to receive the receptacle signal contacts. A front surface of the signal mating body forms a row of receptacle signal ports that are respectively communicated with the corresponding receptacle signal contact-receiving passages. Each of the receptacle power contacts includes a vertical plate, an elastic clamp bending from a front edge of the vertical plate, and a tail portion horizontally extending backward from a rear edge of the vertical plate. The vertical plate is fixed in the corresponding receptacle power contact-receiving passage, the elastic clamp enters into the corresponding receptacle power port, and the tail portion extends out of the rear surface of the power base. Each of the receptacle signal contacts includes a horizontal plate, a forked head horizontally extending forward from a front edge of the horizontal plate, and a back end horizontally extending backward from a rear edge of the horizontal plate. The horizontal plate is fixed in the corresponding receptacle signal contact-receiving passage, the forked head enters into the corresponding receptacle signal port, and the back end extends out of the rear surface of the signal base.

In one embodiment, the power base further forms a concave space and two dovetail grooves, the concave space is located on a bottom surface of the power base and has a larger area, and the two dovetail grooves are respectively and symmetrically located two sides of the concave space.

In one embodiment, the signal base further forms a retaining block on a top surface thereof, and the retaining block is received in the concave space and engaged with the dovetail grooves.

The present invention further provides an electrical connector assembly, comprising a plug connector as described above and a receptacle connector as described above. When the plug connector is engaged with the receptacle connector, the power mating bodies and the signal mating body of the receptacle connector respectively enter into the corresponding plug power ports and the plug signal port of the plug connector, the plug power contacts and the plug signal contacts respectively enter into the receptacle power ports and the receptacle signal ports, the vertical blade-shaped mating end of the plug power contact is inserted into the elastic clamp of the corresponding receptacle power contact, and the head of the plug signal contact is inserted into the forked head of the corresponding receptacle signal contact.

In comparison with the prior art, the plug connector, the receptacle connector and the electrical connector assembly according to the present invention can construct a compact structure by disposing two stacked signal port and power port, thereby saving the edge space of a circuit board and being capable of disposing more other type connectors on the edge of the circuit board.

DETAILED DESCRIPTION OF THE PREFERRED EMBODIMENTS

Figure 1:
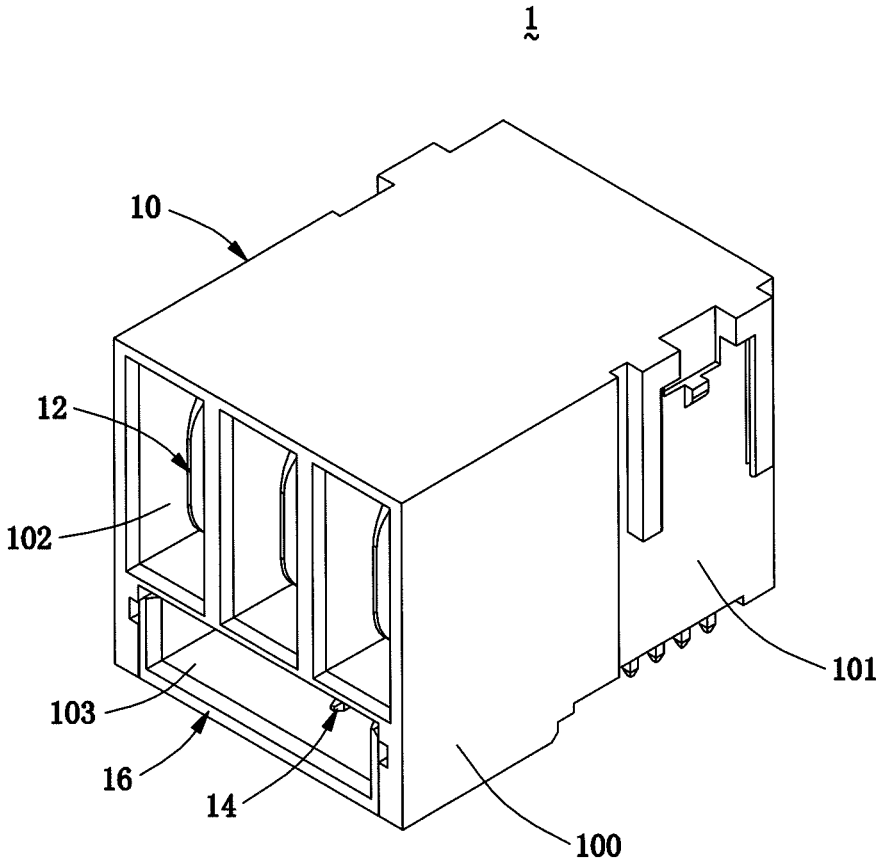
FIG. 1 is a perspective schematic view of a plug connector of the present invention.

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention. In the drawings, the components having similar structures are denoted by the same numerals.

Figure 2:
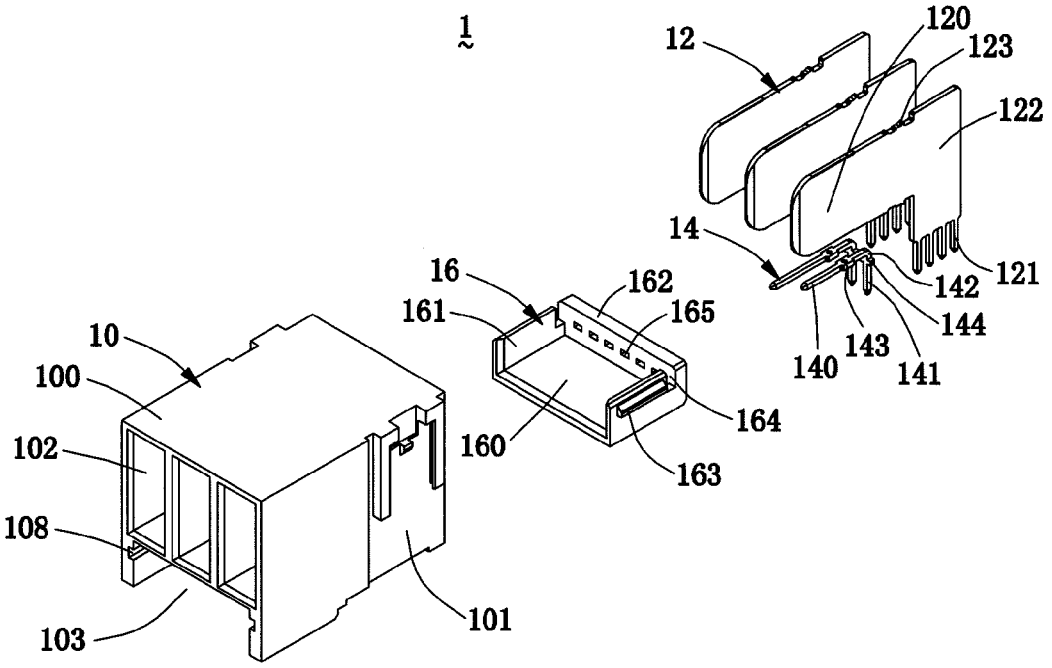
FIG. 2 is an exploded view of the plug connector shown in FIG. 1.
Figure 3:
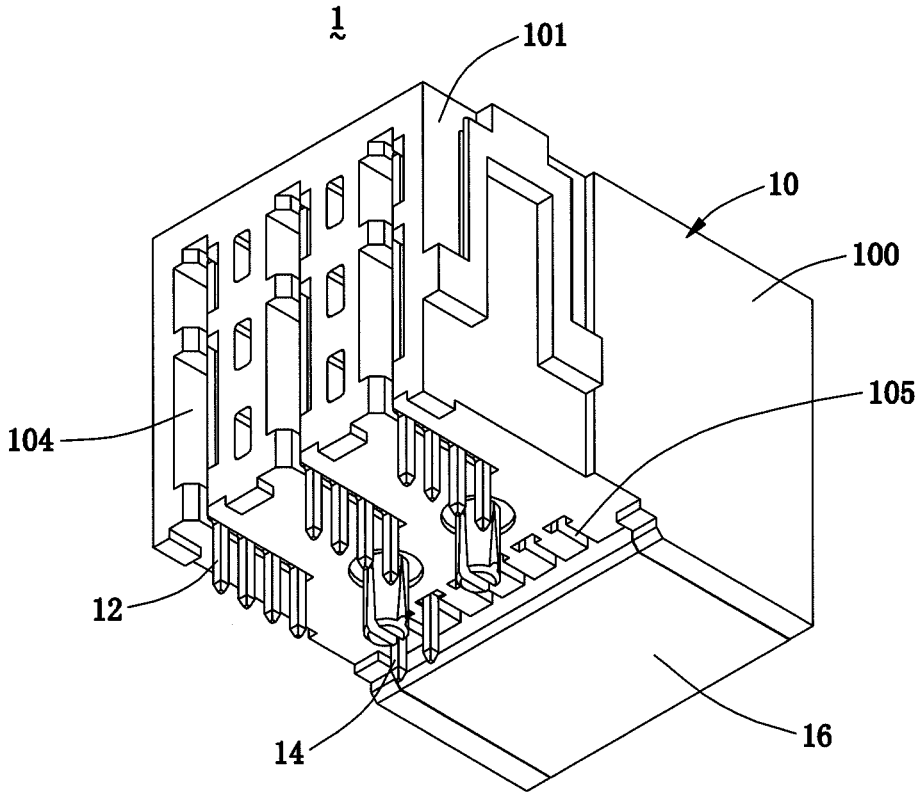
FIG. 3 is a perspective schematic view of the plug connector of the present invention along another direction.
Figure 4:
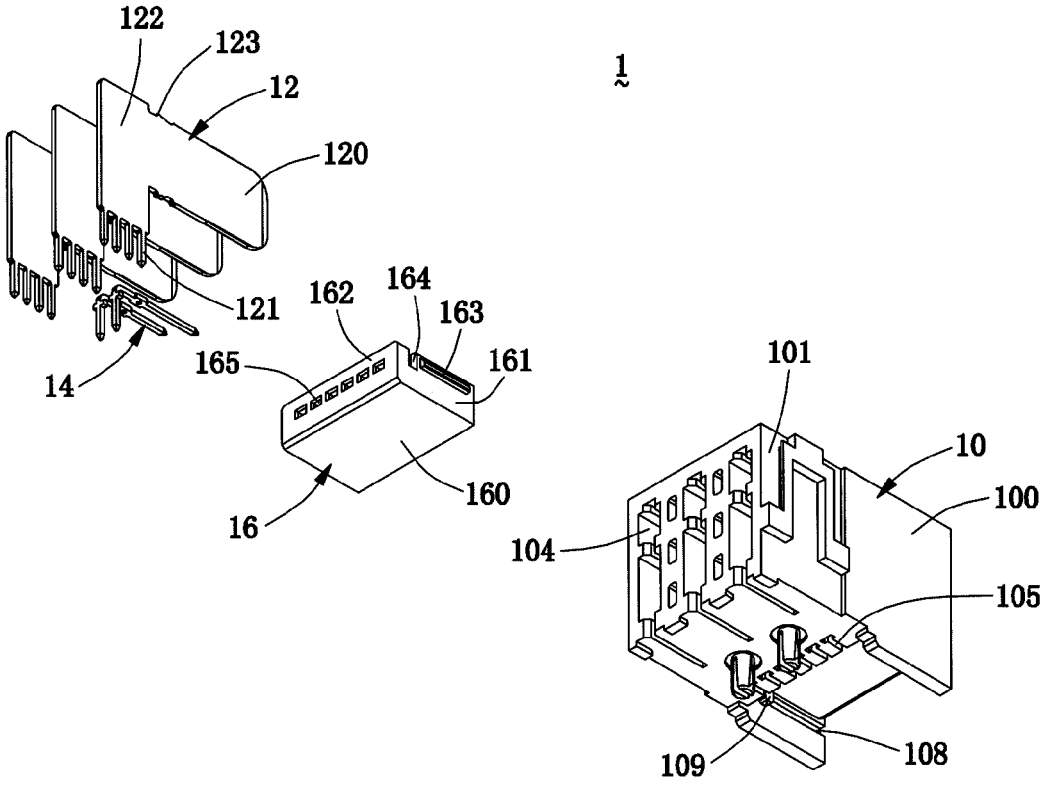
FIG. 4 is an exploded view of the plug connector shown in FIG. 3.
Figure 5:
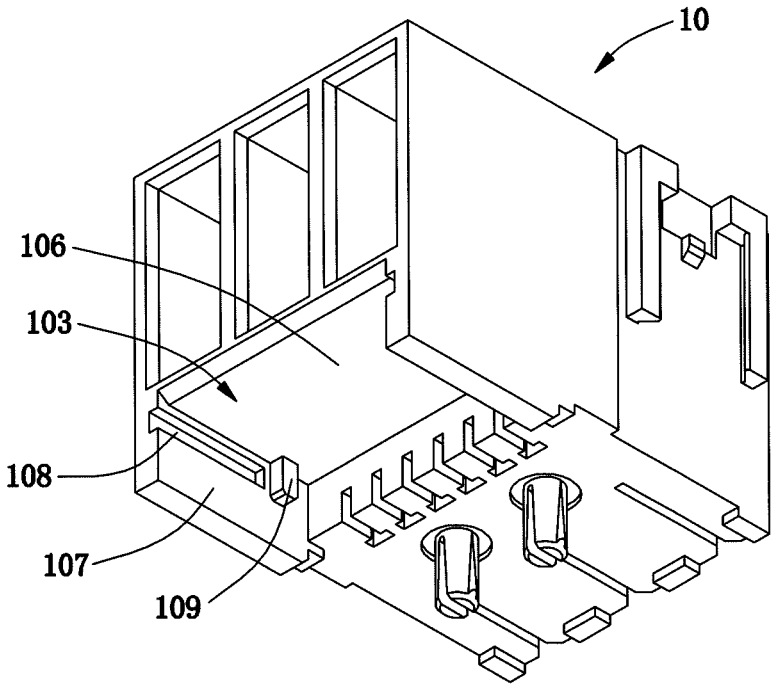
FIG. 5 is a perspective schematic view of a plug housing of the plug connector of the present invention.

Please refer to FIGS. 1 to 5, FIG. 1 is a perspective schematic view of a plug connector 1 of the present invention, FIG. 2 is an exploded view of the plug connector 1 shown in FIG. 1, FIG. 3 is a perspective schematic view of the plug connector 1 of the present invention along another direction, FIG. 4 is an exploded view of the plug connector 1 shown in FIG. 3, and FIG. 5 is a perspective schematic view of a plug housing 10 of the plug connector 1 of the present invention.

Figure 10:
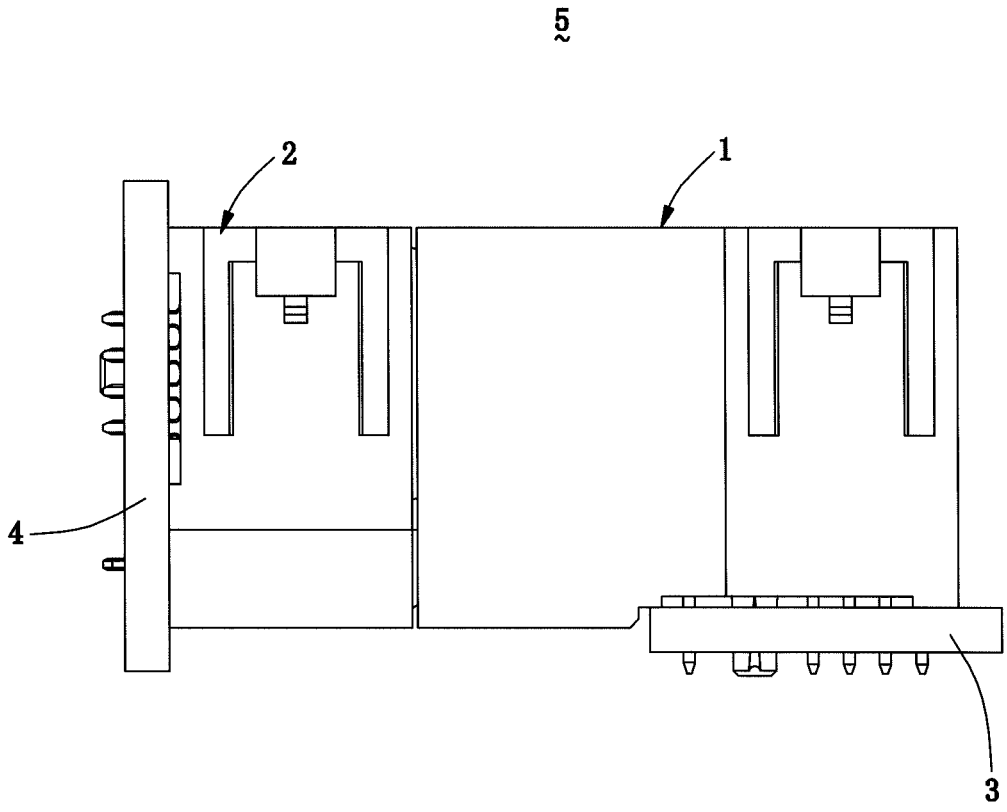
FIG. 10 is a plan view of an electrical connector assembly mounted on two circuit boards.

Please refer to FIGS. 1 to 4, the plug connector 1 of the present invention is a horizontal connector, the mating direction of which is parallel to a first circuit board 3 (as shown by FIG. 10). The plug connector 1 has hybrid ports and can provide the power and signal transmission functions. The plug connector 1 includes a plug housing 10, a row of plug power contacts 12, a row of plug signal contacts 14 and a retaining seat 16.

Please refer to FIGS. 1 to 4, the plug housing 10 has a mating portion 100 located on the front thereof and a mounting portion 101 located on the rear thereof. A front surface of the mating portion 100 is perpendicular to a bottom surface of the mounting portion 101, and a bottom of the mating portion 100 is open.

As shown in FIGS. 1 and 2, the front surface of the mating portion 100 forms a row of plug power ports 102 that are vertical and have identical structures, and one plug signal port 103 located under the row of the plug power ports 102 to form a stacked structure. The plug signal port 103 is flat and has an open bottom. The row of the plug power ports 102 and the plug signal port 103 extend back to the mounting portion 101. The plug signal port 103 and the row of the plug power ports 102 form a stacked structure.

In the embodiment, the row has three identical plug power ports 102. The plug signal port 103 is located under the three plug power ports 102. Of course, the number can not be used to limit the protection scope of the present invention.

As shown in FIGS. 3 and 4, the mounting portion 101 forms a row of plug power contact-receiving passages 104, which pass through a rear surface and the bottom surface of the mounting portion 101 for receiving the plug power contacts 12. Each of the plug power contact-receiving passages 104 is communicated with the corresponding plug power port 102. The mounting portion 101 also forms a row of plug signal contact-receiving passages 105, which are located on the bottom surface of the mounting portion 101 and communicated with the plug signal port 103 for receiving the plug signal contacts 14.

In the embodiment, the number of the power contact-receiving passages 104 is three, and the number of the plug signal contact-receiving passages 105 is six. Of course, these numbers can not be used to limit the protection scope of the present invention.

As shown in FIG. 5, the bottom of the plug signal port 103 of the plug housing 10 is an open structure. Specifically, the plug signal port 103 has a top wall 106 and two opposite sidewalls 107, but no the bottom. Each of the two opposite sidewalls 107 forms a groove 108 and a protrusion 109.

Please refer to FIGS. 2 and 4, the retaining seat 16 is drawer-shaped, and mounted on the bottom of the mating portion 100 (or the plug signal port 103) of the plug housing 10 for closing the open bottom of the plug signal port 103 and fixing the plug signal contacts 14. Specifically, the retaining seat 16 has a bottom board 160, two opposite side boards 161 and a rear board 162. An outside surface of each side board 161 has a rib 163 corresponding to the groove 108 of the plug housing 10, and each side board 161 also has a notch 164 corresponding to the protrusion 109 of the plug housing 10. The rear board 162 forms a row of through holes 165, which pass through a front and rear surfaces thereof, for being passed through by the plug signal contacts 14 and securing the plug signal contacts 14. When the retaining seat 16 is mounted on the plug housing 10, the bottom board 160 closes the open bottom of the plug signal port 103, the rib 163 of the side board 161 enters into the corresponding groove 108 of the plug housing 10, and the protrusion 109 of the plug housing 10 is embedded into the corresponding notch 164 of the side board 161. Now, the rear board 162 of the retaining seat 16 is located at the plug signal contact-receiving passages 105 of the mounting portion 101 to fix the plug signal contacts 14.

Please refer to FIGS. 2 and 3, the row of the plug power contacts 12 includes three plug power contacts 12, each of which can be mounted in the corresponding plug power contact-receiving passage 104 of the plug housing 10. The plug power contact 12 is a vertical plate and includes a mating end 120 being vertical blade-shaped and horizontally extending forward, a tail end 121 being perpendicular to the mating end 120 and extending downward, and a connecting part 122 being an L type vertical blade and connecting the mating end 120 and the tail end 121. In the embodiment, the tail end 121 of the plug power contact 12 consists of a plurality of pins. An upper edge and a lower edge of the connecting part 122 are formed with barbs 123.

When the plug power contacts 12 are mounted on the plug housing 10, the mating end 120 of each plug power contact 12 passes through the plug power contact-receiving passage 104 to enter into the plug power port 102 (shown in FIG. 1) of the plug housing 10, the connecting part 122 is fixed in the plug power contact-receiving passage 104 by the barbs 123, and the tail end 121 extends out of the bottom surface of the mounting portion 101 for preparing to be connected with power points of the first circuit board 3.

Please refer to FIGS. 2 and 3, the row of the plug signal contacts 14 includes two plug signal contacts 14, each of which can be mounted in the corresponding plug signal contact-receiving passage 105 of the plug housing 10. The plug signal contact 14 includes a head 140 horizontally extending forward, a tail 141 being perpendicular to the head 140 and vertically extending downward, and an L type retaining part 142 connecting the head 140 and the tail 141. The retaining part 142 has a horizontal width part 143 in a horizontal direction and a vertical width part 144 in a vertical direction. In assembly, the head 140 of the plug signal contact 14 is inserted into the through hole 165 of the retaining seat 16, the horizontal width part 143 is fixed in the through hole 165, therefore the plug signal contact 14 and the retaining seat 16 are together mounted on the plug housing 10. The vertical width part 144 of the plug signal contact 14 can enter from the bottom surface of the mounting portion 101 to be fixed in the plug signal contact-receiving passage 105, and the tail 141 thereof can extend out of the bottom surface of the mounting portion 101.

In the embodiment, the plug connector 1 of the present invention includes two plug signal contacts 14. Of course, the number of the plug signal contacts 14 can be adjusted according to the need, so the protection scope of the present invention can not be limited by the number of the plug signal contacts 14.

Figure 6:
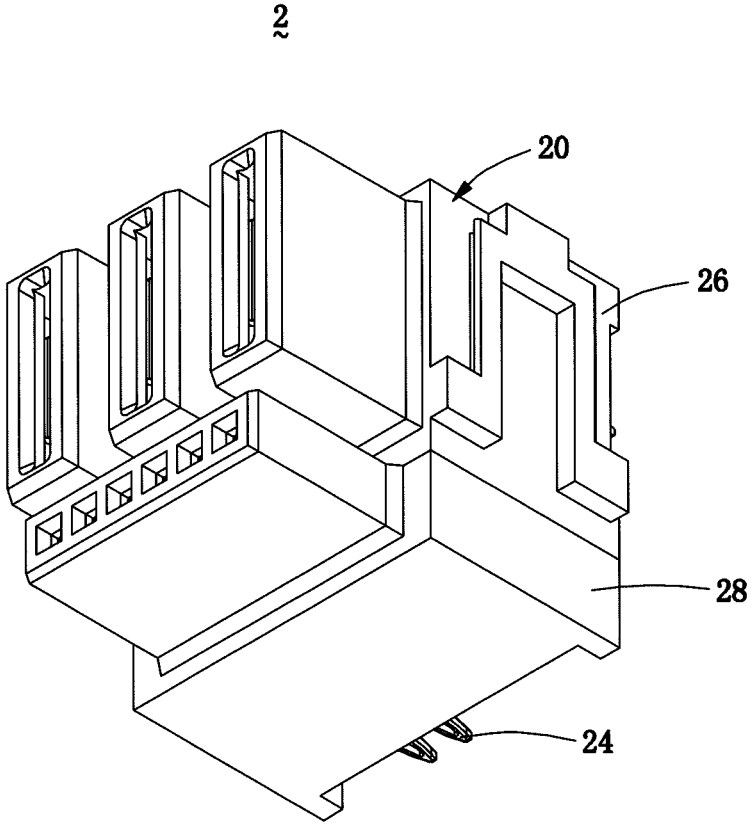
FIG. 6 is a perspective schematic view of a receptacle connector of the present invention.
Figure 7:
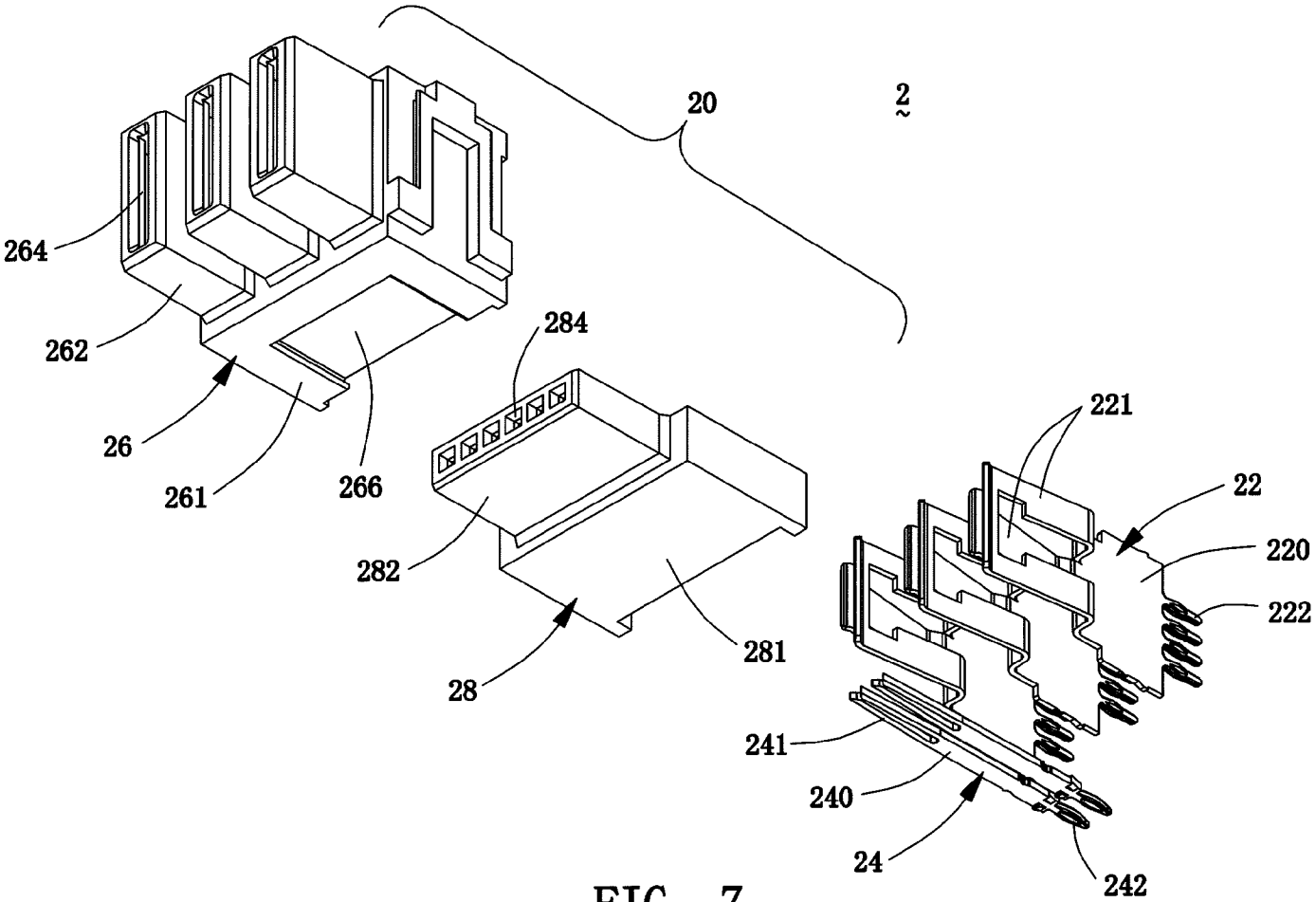
FIG. 7 is an exploded view of the receptacle connector shown in FIG. 6.
Figure 8:
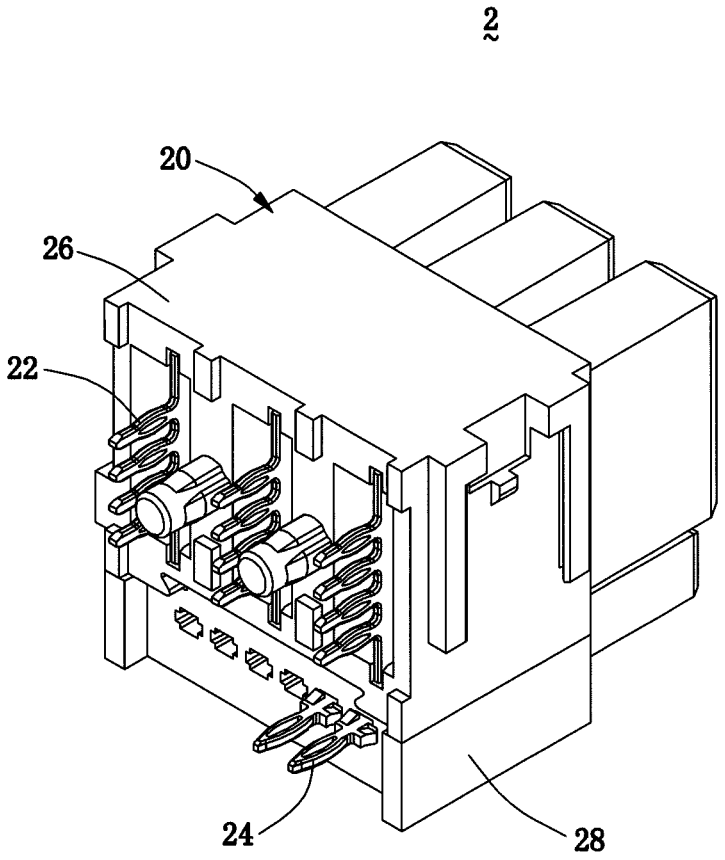
FIG. 8 is a perspective schematic view of the receptacle connector of the present invention along another direction.
Figure 9:
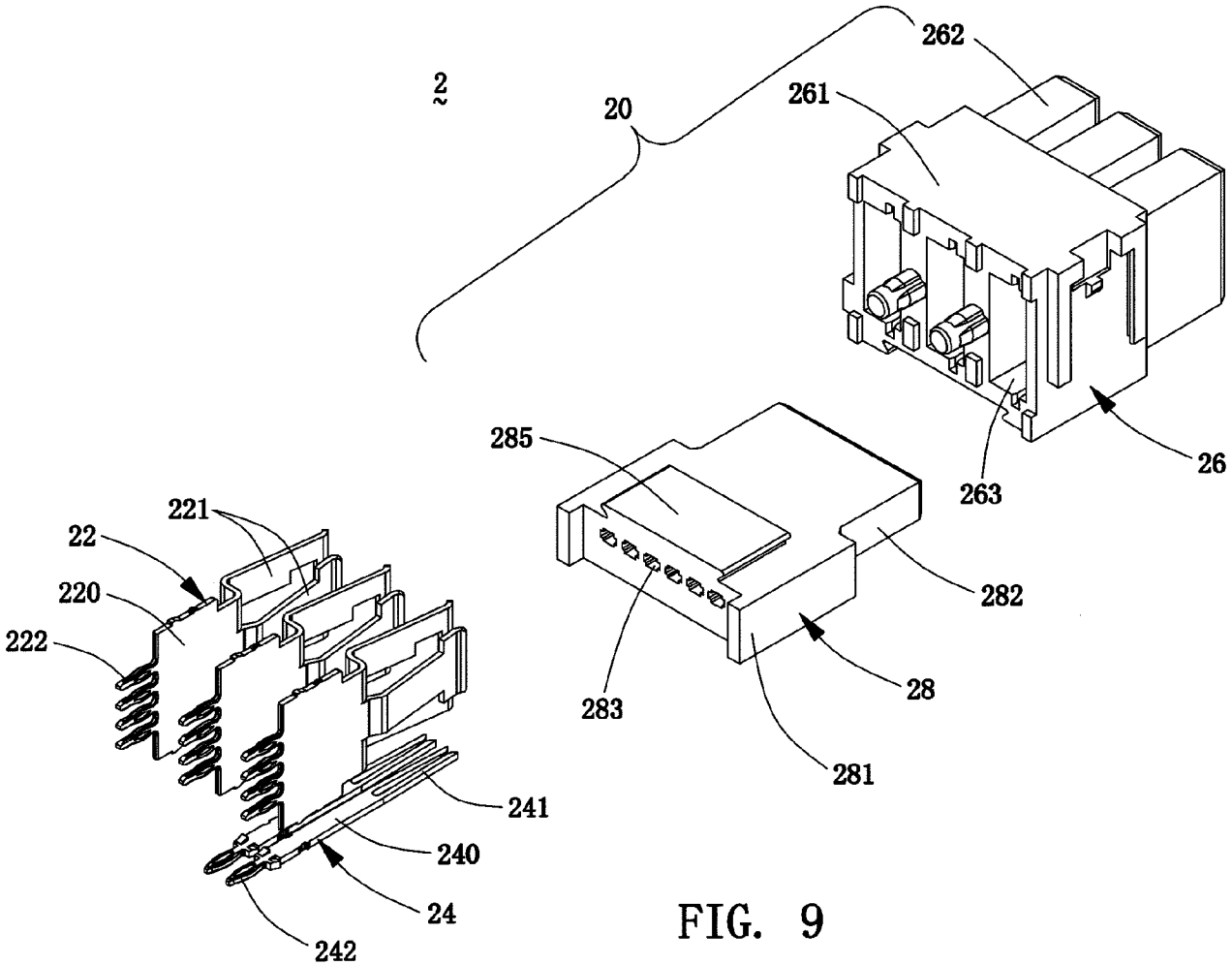
FIG. 9 is an exploded view of the receptacle connector shown in FIG. 8.

Please refer to FIGS. 6 to 9, FIG. 6 is a perspective schematic view of a receptacle connector 2 of the present invention, FIG. 7 is an exploded view of the receptacle connector 2 shown in FIG. 6, FIG. 8 is a perspective schematic view of the receptacle connector 2 of the present invention along another direction, and FIG. 9 is an exploded view of the receptacle connector 2 shown in FIG. 8.

Please refer to FIGS. 6 to 9, the receptacle connector 2 of the present invention is a vertical connector, the mating direction of which is perpendicular to a second circuit board 4 (as shown in FIG. 10). The receptacle connector 2 has hybrid ports and can provide the power and signal transmission functions. The receptacle connector 2 includes a receptacle housing 20, a row of receptacle power contacts 22 and a row of receptacle signal contacts 24.

Please refer to FIGS. 6 to 9, the receptacle housing 20 includes a power receptacle housing 26 and a signal receptacle housing 28 mounted under the power receptacle housing 26. The power receptacle housing 26 and the signal receptacle housing 28 are stacked and connected together.

As shown in FIGS. 7 and 9, the power receptacle housing 26 includes a power base 261 and a row of power mating bodies 262. The power mating bodies 262 are vertical and have identical structures. The power mating bodies 262 are in parallel and protrude forward from a front surface of the power base 261. The power base 261 forms a row of receptacle power contact-receiving passages 263 passing through the front surface and a rear surface of the power base 261 for receiving the receptacle power contacts 22. A front surface of each power mating body 262 forms one vertical receptacle power port 264 extending backward to the power base 262 and being communicated with the corresponding receptacle power contact-receiving passage 263. In the embodiment, the numbers of the receptacle power contact-receiving passages 263 and the receptacle power ports 264 are three, and the receptacle power ports 264 have identical structures. Moreover, as shown in FIG. 7, the power base 261 also forms a concave space 265 having a larger area on a bottom surface of the power base 261, and two dovetail grooves 266 respectively and symmetrically located two sides of the concave space 265.

As shown in FIGS. 7 and 9, the signal receptacle housing includes a flat signal base 281 and a flat and horizontal signal mating body 282 horizontally protruding forward from a front surface of the signal base 281. The signal base 281 forms a row of receptacle signal contact-receiving passages 283 that pass through the front surface and a rear surface of the signal base 281 and are used to receive the receptacle signal contacts 24. A front surface of the signal mating body 282 forms a row of receptacle signal ports 284, which extend backward to the signal base 281 and are respectively communicated with the corresponding receptacle signal contact-receiving passages 283. In the embodiment, the numbers of the receptacle signal ports 284 and the receptacle signal contact-receiving passages 283 are six. Moreover, as shown in FIG. 9, the signal base 281 also forms a retaining block 285 on a top surface thereof. In the embodiment, the retaining block 285 is received in the concave space 265 and is engaged with the dovetail grooves 266, whereby the signal receptacle housing 28 is stacked and fixed under the power receptacle housing 26.

As shown in FIGS. 7 and 9, the row of the receptacle power contacts 22 includes three receptacle power contacts 22, each of which can be mounted in the corresponding receptacle power contact-receiving passage 263 of the receptacle housing 22. The receptacle power contact 22 includes a vertical plate 220, an elastic clamp 221 bending from a front edge of the vertical plate 220, and a tail portion 222 horizontally extending backward from a rear edge of the vertical plate 220. The vertical plate 220 is fixed in the corresponding receptacle power contact-receiving passage 263, the elastic clamp 221 enters into the corresponding receptacle power port 264 for preparing to be mated with the plug power contact 12 of the plug connector 1, and the tail portion 222 extends out of the rear surface of the power base 261 for preparing to be connected with the second circuit board 4.

In the embodiment, the tail portion 222 of the receptacle power contact 22 consists of a row of needle eye-shaped pins, which can be pressed into conductive holes of the second circuit board 4 and be electrically connected with power points of the second circuit board 4.

As shown in FIGS. 7 and 9, the row of the receptacle signal contacts 24 includes two receptacle signal contacts 24. Each receptacle signal contact 24 is mounted in the corresponding receptacle signal contact-receiving passage 283 of the signal receptacle housing 28. The receptacle signal contact 24 includes a horizontal plate 240, a forked head 241 horizontally extending forward from a front edge of the horizontal plate 240, and a back end 242 horizontally extending backward from a rear edge of the horizontal plate 240. The horizontal plate 240 is fixed in the corresponding receptacle signal contact-receiving passage 283, the forked head 241 enters into the corresponding receptacle signal port 284 for preparing to mate with the plug signal contact 14 of the plug connector 1, and the back end 242 extends out of the rear surface of the signal base 281 for preparing to be connected with the second circuit board 4.

In the embodiment, the back end of each receptacle signal contact 24 is a needle eye-shaped pin.

Please refer to FIG. 10, an electrical connector assembly 5 of the present invention includes the plug connector 1 mounted in parallel on the first circuit board 3 and the receptacle connector 2 perpendicularly mounted on the second circuit board 4. The plug connector 1 is disclosed in FIGS. 1 to 4, and the receptacle connector 2 is disclosed in FIGS. 6 to 9. When the plug connector 1 is connected with the receptacle connector 2, the power mating bodies 262 and the signal mating body 282 of the receptacle connector 2 are respectively inserted into the corresponding plug power ports 102 and the plug signal port 103 of the plug connector 1. Specifically, the blade-shaped mating end 120 of the plug power contact 12 may be inserted into the elastic clamp 221 of the corresponding receptacle power contact 22, and the head 140 of the plug signal contact 14 may be inserted into the forked head 241 of the corresponding receptacle signal contact 24. By this connection way, the plug power contact 12 and the plug signal contact 14 are respectively and electrically connected with the receptacle power contact 22 and the receptacle signal contact 24.

As described above, the power ports 102, 264 and the signal ports 103, 284 are disposed to be a stacked type. Therefore, the plug connector 1 and the receptacle connector 2 of the present invention form more compact structures, and can save edge space of the circuit boards 3 and 4. Further, more other type connectors can be mounted on the edge of the circuit boards 3 and 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising a plug housing, a retaining seat, a row of plug power contacts and a row of plug signal contacts; wherein the plug housing having a mating portion located on the front of the plug housing and a mounting portion located on the rear thereof, a front surface of the mating portion being perpendicular to a bottom surface of the mounting portion, the front surface of the mating portion forming a row of vertical and parallel plug power ports having identical structures and one plug signal port located under the row of the plug power ports to form a stacked structure, a bottom of the plug signal port being open, the plug signal port having a top wall and two opposite sidewalls, the mounting portion forming a row of plug power contact-receiving passages passing through a rear surface and the bottom surface of the mounting portion to receive the plug power contacts, each of the plug power contact-receiving passages being communicated with the corresponding plug power port, the mounting portion further forming a row of plug signal contact-receiving passages that are located on the bottom surface thereof and communicated with the plug signal port to receive the corresponding plug signal contacts;

the retaining seat being drawer-shaped and having a bottom board, two opposite side boards and a rear board, the retaining seat being mounted on the mating portion of the plug housing to close the open bottom of the plug signal port and fixing the plug signal contacts;

each of the plug power contacts being a vertical plate and including a mating end that is vertical blade-shaped and horizontally extending forward, a tail end being perpendicular to the mating end and extending downward, and a connecting part that is an L type vertical blade and connects the mating end and the tail end; wherein the mating end passes through the corresponding plug power contact-receiving passage to enter into the corresponding plug power port, the connecting part is fixed in the corresponding plug power contact-receiving passage, and the tail end extends out of the bottom surface of the mounting portion; and each of the plug signal contacts including a head horizontally extending forward, a tail being perpendicular to the head and vertically extending downward, and an L type retaining part connecting the head and the tail; wherein the head is inserted into the plug signal port, one portion of the L type retaining part is fixed in the plug signal contact-receiving passage, the other portion thereof is fixed in the retaining seat, and the tail extends out of the bottom surface of the mounting portion.

2. The plug connector as claimed in claim 1, wherein each of the two opposite sidewalls of the plug signal port forms a groove and a protrusion.

3. The plug connector as claimed in claim 2, wherein an outside surface of each side board of the retaining seat has a rib corresponding to the groove, and the each side board has a notch corresponding to the protrusion.

4. The plug connector as claimed in claim 3, wherein the rear board of the retaining seat forms a row of through holes, which pass through a front and rear surfaces of the rear board.

5. The plug connector as claimed in claim 4, wherein the retaining part of the plug signal contact has a horizontal width part in a horizontal direction and a vertical width part in a vertical direction, the head of the plug signal contact passes through the through hole of the retaining seat and is inserted into the plug signal port, the horizontal width part is fixed in the through hole, and the vertical width part is fixed in the plug signal contact-receiving passage.

6. A receptacle connector, comprising a receptacle housing, a row of receptacle power contacts and a row of receptacle signal contacts; wherein the receptacle housing including a power receptacle housing and a signal receptacle housing mounted under the power receptacle housing, the power receptacle housing and the signal receptacle housing being stacked and connected together;

the power receptacle housing including a power base and a row of vertical power mating bodies having identical structures, the row of the power mating bodies being in parallel and protruding forward from a front surface of the power base, the power base forming a row of receptacle power contact-receiving passages that pass through the front surface and a rear surface of the power base to receive the receptacle power contacts, a front surface of each power mating body forming one vertical receptacle power port that extends backward to the power base and is communicated with the corresponding receptacle power contact-receiving passage;

the signal receptacle housing including a flat signal base and a flat and horizontal signal mating body, the signal mating body horizontally protruding forward from a front surface of the signal base, the signal base forming a row of receptacle signal contact-receiving passages that pass through the front surface and a rear surface of the signal base and are used to receive the receptacle signal contacts, a front surface of the signal mating body forming a row of receptacle signal ports that are respectively communicated with the corresponding receptacle signal contact-receiving passages;

each of the receptacle power contacts including a vertical plate, an elastic clamp bending from a front edge of the vertical plate, and a tail portion horizontally extending backward from a rear edge of the vertical plate, wherein the vertical plate is fixed in the corresponding receptacle power contact-receiving passage, the elastic clamp enters into the corresponding receptacle power port, and the tail portion extends out of the rear surface of the power base; and each of the receptacle signal contacts including a horizontal plate, a forked head horizontally extending forward from a front edge of the horizontal plate, and a back end horizontally extending backward from a rear edge of the horizontal plate, wherein the horizontal plate is fixed in the corresponding receptacle signal contact-receiving passage, the forked head enters into the corresponding receptacle signal port, and the back end extends out of the rear surface of the signal base.

7. The receptacle connector as claimed in claim 6, wherein the power base further forms a concave space and two dovetail grooves, the concave space is located on a bottom surface of the power base and has a larger area, and the two dovetail grooves are respectively and symmetrically located two sides of the concave space.

8. The receptacle connector as claimed in claim 7, wherein the signal base further forms a retaining block on a top surface thereof, and the retaining block is received in the concave space and engaged with the dovetail grooves.

9. An electrical connector assembly, comprising:

a plug connector comprising a plug housing, a retaining seat, a row of plug power contacts and a row of plug signal contacts; wherein the plug housing having a mating portion located on the front of the plug housing and a mounting portion located on the rear thereof, a front surface of the mating portion being perpendicular to a bottom surface of the mounting portion, the front surface of the mating portion forming a row of vertical and parallel plug power ports having identical structures and one plug signal port located under the row of the plug power ports to form a stacked structure, a bottom of the plug signal port being open, the plug signal port having a top wall and two opposite sidewalls, the mounting portion forming a row of plug power contact-receiving passages passing through a rear surface and the bottom surface of the mounting portion to receive the plug power contacts, each of the plug power contact-receiving passages being communicated with the corresponding plug power port, the mounting portion further forming a row of plug signal contact-receiving passages that are located on the bottom surface thereof and communicated with the plug signal port to receive the corresponding plug signal contacts;

the retaining seat being drawer-shaped and having a bottom board, two opposite side boards and a rear board, the retaining seat being mounted on the mating portion of the plug housing to close the open bottom of the plug signal port and fixing the plug signal contacts;

each of the plug power contacts being a vertical plate and including a mating end that is vertical blade-shaped and horizontally extending forward, a tail end being perpendicular to the mating end and extending downward, and a connecting part that is an L type vertical blade and connects the mating end and the tail end; wherein the mating end passes through the corresponding plug power contact-receiving passage to enter into the corresponding plug power port, the connecting part is fixed in the corresponding plug power contact-receiving passage, and the tail end extends out of the bottom surface of the mounting portion; and each of the plug signal contacts including a head horizontally extending forward, a tail being perpendicular to the head and vertically extending downward, and an L type retaining part connecting the head and the tail; wherein the head is inserted into the plug signal port, one portion of the L type retaining part is fixed in the plug signal contact-receiving passage, the other portion thereof is fixed in the retaining seat, and the tail extends out of the bottom surface of the mounting portion; and a receptacle connector comprising a receptacle housing, a row of receptacle power contacts and a row of receptacle signal contacts; wherein the receptacle housing including a power receptacle housing and a signal receptacle housing mounted under the power receptacle housing, the power receptacle housing and the signal receptacle housing being stacked and connected together;

the power receptacle housing including a power base and a row of vertical power mating bodies having identical structures, the row of the power mating bodies being in parallel and protruding forward from a front surface of the power base, the power base forming a row of receptacle power contact-receiving passages that pass through the front surface and a rear surface of the power base to receive the receptacle power contacts, a front surface of each power mating body forming one vertical receptacle power port that extends backward to the power base and is communicated with the corresponding receptacle power contact-receiving passage;

the signal receptacle housing including a flat signal base and a flat and horizontal signal mating body, the signal mating body horizontally protruding forward from a front surface of the signal base, the signal base forming a row of receptacle signal contact-receiving passages that pass through the front surface and a rear surface of the signal base and are used to receive the receptacle signal contacts, a front surface of the signal mating body forming a row of receptacle signal ports that are respectively communicated with the corresponding receptacle signal contact-receiving passages;

each of the receptacle power contacts including a vertical plate, an elastic clamp bending from a front edge of the vertical plate, and a tail portion horizontally extending backward from a rear edge of the vertical plate, wherein the vertical plate is fixed in the corresponding receptacle power contact-receiving passage, the elastic clamp enters into the corresponding receptacle power port, and the tail portion extends out of the rear surface of the power base; and each of the receptacle signal contacts including a horizontal plate, a forked head horizontally extending forward from a front edge of the horizontal plate, and a back end horizontally extending backward from a rear edge of the horizontal plate, wherein the horizontal plate is fixed in the corresponding receptacle signal contact-receiving passage, the forked head enters into the corresponding receptacle signal port, and the back end extends out of the rear surface of the signal base;

wherein when the plug connector is engaged with the receptacle connector, the power mating bodies and the signal mating body of the receptacle connector respectively entering into the corresponding plug power ports and the plug signal port of the plug connector, the plug power contacts and the plug signal contacts respectively entering into the receptacle power ports and the receptacle signal ports, the vertical blade-shaped mating end of the plug power contact being inserted into the elastic clamp of the corresponding receptacle power contact, and the head of the plug signal contact being inserted into the forked head of the corresponding receptacle signal contact.

* * * * *